US005976778A

United States Patent [19]

Brust et al.

[11] Patent Number: 5,976,778

[45] Date of Patent: Nov. 2, 1999

[54] PROCESS FOR THE PREPARATION OF SILVER HALIDE EMULSIONS CONTAINING DISPERSED CLUMPS OF FINE GRAINS

[75] Inventors: Thomas B. Brust, Webster; Mark R. Mis, Cheektowaga; David H. Levy, Rochester; Donald L. Black, Webster, all of N.Y.

[73] Assignee: Eastman Kodak Company, Rochester, N.Y.

[21] Appl. No.: 09/179,700

[22] Filed: Oct. 27, 1998

[51] Int. Cl.[6] ..... G03C 1/015; G03C 1/035; G03C 1/043; G03C 1/047

[52] U.S. Cl. ..... 430/569; 430/567; 430/568; 430/637; 430/642

[58] Field of Search ..... 430/567, 569, 430/642, 568, 637

[56] References Cited

U.S. PATENT DOCUMENTS

| | | | |
|---|---|---|---|
| 4,334,012 | 6/1982 | Mignot | 430/567 |
| 4,356,257 | 10/1982 | Gerber | 430/496 |
| 5,512,426 | 4/1996 | Levy | 430/567 |

*Primary Examiner*—Mark F. Huff
*Attorney, Agent, or Firm*—Carl O. Thomas

[57] ABSTRACT

A process of preparing a radiation-sensitive silver halide emulsion is disclosed in which the silver halide grains form dispersed clumps. A population of fine silver halide grains is precipitated at higher concentrations than previously taught for preparing this type of an emulsion by employing a peptizer limited in amount, limited in methionine content, or both. Following formation of the grains, they are aggregated into clumps by the addition of a surfactant, optionally assisted by the adding iodide, increasing pH or both. The grain clumps are stabilized against further aggregation by adding a high methionine peptizer and optionally assisted by the precipitation of additional silver halide.

12 Claims, No Drawings

PROCESS FOR THE PREPARATION OF SILVER HALIDE EMULSIONS CONTAINING DISPERSED CLUMPS OF FINE GRAINS

FIELD OF THE INVENTION

The invention relates to the preparation of radiation-sensitive silver halide emulsions useful in photographic imaging.

BACKGROUND OF THE INVENTION

Typically soluble silver and halide salts are reacted in an aqueous dispersing medium containing a peptizer to form radiation-sensitive silver halide grains. The grains are separated from each other physically and held in suspension by the peptizer. Occasionally a small percentage of the grains are observed to aggregate, but these grain aggregations are easily removed by filtration before the emulsion is coated.

Mignot U.S. Pat. No. 4,334,012 discloses a method for precipitating fine silver halide grains in the absence of a peptizer. Mignot avoids grain aggregation in the absence of a peptizer by limiting the concentration of soluble salts to less than 0.1 mole per liter (M/L). At higher salt concentrations, typical of those used in precipitating silver halide grains in the presence of a peptizer, uncontrolled grain aggregation occurs in the absence of a peptizer, rendering the resulting composition uncoatable and unsuitable for imaging applications.

Levy U.S. Pat. No. 5,512,426 departs from the ordinary practice of silver halide emulsion manufacture in that the formation of dispersed grain clumps is sought as an alternative to the conventional practice of keeping individual grains separated from one another in the dispersing medium. Levy precipitates fine silver halide grains in an aqueous dispersing medium that does not contain a peptizer. To avoid uncontrolled grain aggregation Levy, like Mignot, teaches working with dilute dispersions. Specifically, Levy teaches maintaining silver concentrations below 0.1 M/L. The fine grains are chemically sensitized and then aggregated into dispersed clumps having a mean equivalent circular diameter (ECD) of up to 10 $\mu$m. Peptizer is then added to stabilize the dispersion of the clumps.

SUMMARY OF THE INVENTION

In one aspect, this invention is directed to a process of preparing a radiation-sensitive silver halide emulsion comprising (A) precipitating in an aqueous dispersing medium from 0.3 to 3 moles of silver per liter in the form of fine silver halide grains having a face centered cubic crystal lattice structure in the presence of at least 1 gram per liter of a first peptizer, (B) aggregating the silver halide grains into dispersed clumps, the clumps having a mean equivalent circular diameter of less than 10 $\mu$m, and (C) stabilizing the clumps against further aggregation.

The process of the present invention offers significant advantages over the teachings of Levy. For example, fine grain nucleation and growth is undertaken in the presence of peptizer. This allows common grain crystal habits and overall grain concentrations to be realized. Stated another way, the highly dilute (and therefore inefficient from the viewpoint of utilizing manufacturing resources) precipitations contemplated by Levy are avoided.

The present invention is based on the discovery that the initial presence of peptizer can be relied upon for the efficient formation of fine silver halide grains while still retaining the capability of forming grain clumps of the type sought by Levy.

Additionally, whereas Levy contemplates the formation of grain clumps during or following grain sensitization, the process of the present invention allows stable grain clumps to be formed before proceeding to grain sensitization. Several advantages are realized by this capability. First, a stable emulsion is formed before proceeding to chemical sensitization. Hence, emulsion sensitization can be deferred to a convenient subsequent time in manufacture, as is common practice, whereas Levy, by reason of precipitating fine grain populations in dilute aqueous dispersing media lacking peptizer, does not provide emulsions that can be conveniently and safely stored before sensitization. Second, the present invention offers the advantage of allowing sensitization to be conducted on stable grain clumps, thereby assuring that sensitizer remains at surface locations and does not interfere with grain clumping.

Finally, the present invention teaches techniques for bonding the fine silver halide grains in clumps that are neither taught nor suggested by Levy.

DETAILED DESCRIPTION OF THE INVENTION

The present invention is directed to a process of preparing a radiation-sensitive silver halide emulsion comprising (A) precipitating in an aqueous dispersing medium from 0.3 to 3 moles of silver per liter in the form of fine silver halide grains having a face centered cubic crystal lattice structure in the presence of at least 1 gram per liter of a peptizer, (B) aggregating the silver halide grains into dispersed clumps, the clumps having a mean equivalent circular diameter of less than 10 $\mu$m, and (C) stabilizing the clumps against further aggregation.

Step (A) of the invention involves precipitating a fine grain population. The term "fine grain" is employed to indicate a grain population in which the mean ECD of the grains less than 0.4 $\mu$m. The process of this invention allows grains larger than the <0.30 $\mu$m grains contemplated by Levy; however, to maintain large surface areas fine (<40 $\mu$m) are still contemplated. The fine grains can be range in size (ECD) down to the sizes of conventional Lippmann emulsions. For example, grain sizes can range down to 0.01 $\mu$m or less. For convenience in handling, it is preferred that the grains have a mean ECD of at least 0.05 $\mu$m. A maximum mean grain size of less than 0.30 $\mu$m is preferred.

The grains can take the form of high (>50 mole %, based on Ag) chloride or high bromide grains commonly used as radiation-sensitive grains in photographic emulsions. These grains exhibit a face centered cubic crystal lattice structure of the rock salt type. The grains can consist of either silver chloride or silver bromide or can consist of a mixture of silver chloride or silver bromide in any proportion. In other words, both silver chlorobromide and silver bromochloride grains are contemplated, where mixed halides are named in order of ascending halide concentrations.

The face centered cubic lattice crystal structures are well known to be capable of incorporating iodide up to its saturation limit. This is generally cited as about 40 mole percent iodide, based on silver, in a silver bromide crystal lattice structure and about 11 mole percent iodide, based on silver, in a silver chloride crystal lattice structure, although slightly higher or lower incorporations can be realized, depending upon the specific conditions of preparation. The incorporation of iodide ion is art recognized to be advantageous for increasing native blue light absorption at all concentrations and for increasing radiation-sensitivity with incorporations of about 0.1 (preferably 0.5) mole percent, based on silver, or higher. Iodide ion incorporation, particularly in concentration ranges of from about 1 to 15 mole percent, based on silver, are commonly employed in color photography for improving imaging characteristics. A prime disadvantage of iodide incorporation is that development times are slowed. Thus, in applications requiring rapid (<90 seconds dry-to-dry) processing, such as is commonly practiced in radiography, iodide concentrations are preferably limited to less than 4 mole percent, based on silver. Silver iodobromide, silver iodochloride, silver iodochlorobromide and silver iodobromochloride grains are within the contemplation of the invention.

To form a stable fine grain emulsion that can be stored after precipitation and before subsequent manufacturing steps, it is contemplated to incorporate in the aqueous dispersing medium before or during grain formation at least 1 g/L of a peptizer. This allows the concentrations of the fine grains present at the conclusion of precipitation to be much higher than the <0.1 mole Ag per liter concentration maximum contemplated by Levy. Specifically, it is preferred that the fine grains at the conclusion of precipitation step (A) to be present in the dispersing medium in a concentration of at least 0.3 mole Ag per liter. Higher Ag concentrations up to the highest conventional concentrations of silver halide grain precipitation, about 3 moles Ag per liter, are contemplated, but final Ag concentrations in the range of from 0.5 to 2 moles Ag per liter are preferred.

The concentration of the peptizer employed in step (A) is maintained at or above 1 g/L and can range up the highest levels conventionally employed in the precipitation of radiation-sensitive silver halide grains, about 60 g/L, with an upper peptizer concentration of 40 g/L being a preferred maximum. The exact choice of a peptizer concentration depends upon (a) the choice of peptizer and (b) the manner in which the peptizer is managed during subsequent steps of the process. Where the peptizer adsorbed to the grain surfaces in step (A) is chosen to remain permanently adsorbed to the grain surfaces (i.e., is not subsequently displaced), it is preferred to limit the peptizer to 10 g/L or less of the emulsion present at the conclusion of step (A).

Gelatin and gelatin derivatives are the most commonly employed peptizers in preparing radiation-sensitive silver halide emulsions. These peptizers are formed of varied combinations of amino acids. As taught by Maskasky U.S. Pat. Nos. 4,713,320 (Maskasky I) and 4,713,323 (Maskasky II), here incorporated by reference, the adsorption of gelatin and gelatin derivatives to silver halide grain surfaces is enhanced by the presence of the amino acid methionine by reason of a strong affinity of Ag ion for the divalent sulfur atom of the methionine. When gelatin or a gelatin derivative peptizer containing a high level of methionine per gram (using the definition of Maskasky I and II, which requires 30 or more micromoles of methionine per gram) is employed in step (A), hereinafter referred to as high methionine peptizer, it is contemplated to limit the concentration of the peptizer to 10 g/L or less, since the peptizer remains adsorbed to the grain surfaces throughout the process of the invention. Limiting the concentration of the peptizer leaves grain surface area free for absorption of a clumping initiator that counteracts the dispersing action of the peptizer.

In a specifically preferred form of the invention the peptizer is a low methionine peptizer (using the definition of Maskasky I and II, which requires less than 30 or more micromoles of methionine per gram). Low methionine gelatin and gelatin derivatives are occasionally obtained directly from natural sources, but in most instances low methionine peptizer is obtained by treating the peptizer with an oxidizing agent. Preferably the low methionine peptizer exhibits a methionine content of less than 12 micromoles per gram and optimally the peptizer is treated with an oxidizing agent to render it free of measurable methionine (i.e., <4 micromoles per gram). In this form gelatin and gelatin derivatives are fully capable of peptizing silver halide grains, as taught by Maskasky I and II, but it is the recognition of this invention that the low methionine gelatin or gelatin derivative can be subsequently displaced from the grain surfaces to allow grain clumping to occur. When low methionine gelatin or gelatin derivative is employed, the highest conventional levels of peptizer can be present in step (A), with a preferred concentration range being from 10 to 40 grams per liter.

In step (B) of the process of the invention, the fine grain silver halide grains are aggregated into dispersed clumps having a mean ECD of less than 10 $\mu$m. Despite the clumping together of individual grains, the limited sizes of the individual clumps allow the grains to remain suspended in the dispersing medium. This is readily distinguished from so-called "clumping out" precipitation failures in which a massive aggregation of grains occurs and the clumped grains promptly settle out of the dispersing medium.

The size of the grain clumps can be varied to satisfy the desired balance of radiation-sensitivity (speed) and image noise (granularity) that is best suited to a particular imaging applications. The smallest possible clump contains at least 2 grains. Generally it is preferred that each clump contain on average at least 5 grains. For most photographic applications grain clumps ranging from 0.2 to 5 $\mu$m are preferred.

To initiate clumping a compound is added to the fine grain emulsion prepared in step (A) that adsorbs to the grain surfaces and produces an affinity between the grains that brings them together in dispersed clumps. In one form of the invention the peptizer employed in step (A) is limited in concentration so that the clumping initiator can adsorb to grain surfaces without displacing peptizer. In an alternative form, which is preferred, the clumping initiator is chosen to have a stronger affinity for the grain surfaces than the peptizer. In this instance the peptizer is actually displaced from the grain surface by the clumping initiator. Generally useful concentrations of the clumping initiator are from 0.1 to 10 grams per Ag mole.

Surfactants are specifically contemplated for use as clumping initiators. By definition a surfactant is a compound having at least one hydrophilic moiety and at least one hydrophobic moiety. A preferred class of surfactants for use in the practice of this invention are non-ionic polyalkylene oxide block copolymers of the type disclosed in Tsaur et al U.S. Pat. Nos. 5,147,771, 5,147,772, 5,147,773 and 5,171,659, the disclosures of which are here incorporate by reference.

In one preferred form the Tsaur et al surfactants are comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

| (I) | | |
|---|---|---|
| LAO1 | HAO1 | LAO1 |

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

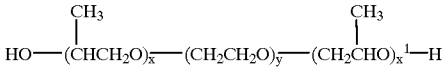

(II)

where x and $x^1$ are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and $x^1$, y can range from 2 to 300 or more.

Generally any category S-I surfactant block copolymer that retains the dispersion characteristics of a surfactant can be employed. The surfactants are effective either dissolved or physically dispersed in the reaction vessel. Auxiliary solvents (e.g., a water miscible alcohol) and/or vigorous stirring are effective techniques for facilitating dispersion of the surfactants. In general category S-I surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

| (III) | | |
|---|---|---|
| HAO2 | LAO2 | HAO2 |

where

HAO2 in each occurrence represents a terminal hydrophilic alkylene oxide block unit and LAO2 represents a linking lipophilic alkylene oxide block unit. It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

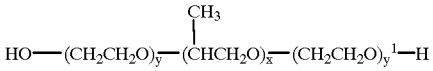

(IV)

where x is at least 13 and can range up to 490 or more and y and $y^1$ are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and $y^1$ can range from 1 (preferably 2) to 320 or more.

Generally any category S-II surfactant block copolymer that retains the dispersion characteristics of a surfactant can be employed. The surfactants are effective either dissolved or physically dispersed in the reaction vessel. Auxiliary solvents (e.g., a water miscible alcohol) and/or vigorous stirring are effective techniques for facilitating dispersion of the surfactants. In general category S-II surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(H\text{-}HAO3)_z\text{-}LOL\text{-}(HAO3\text{-}H)_{z^1} \quad (V)$$

where

HAO3 in each occurrence represents a terminal hydrophilic alkylene oxide block unit, LOL represents a lipophilic alkylene oxide block linking unit, z is 2 and $z^1$ is 1 or 2.

The polyalkylene oxide block copolymer surfactants employed can take the form shown in formula VI:

$$(H\text{-}HAO3\text{-}LAO3)_z\text{-}L\text{-}(LAO3\text{-}HAO3\text{-}H)_{z^1} \quad (VI)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and $z^1$ is 1 or 2.

The linking group L can take any convenient form. It is generally preferred to choose a linking group that is itself lipophilic. When $z+z^1$ equal three, the linking group must be trivalent. Amines can be used as trivalent linking groups. When an amine is used to form the linking unit L, the polyalkylene oxide block copolymer surfactants employed can take the form shown in formula VII:

(VII)

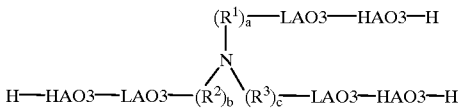

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XIV.

When $z+z^1$ equal four, the linking group must be tetravalent. Diamines are preferred tetravalent linking groups. When a diamine is used to form the linking unit L, the polyalkylene oxide block copolymer surfactants employed can take the form shown in formula VII:

(VIII)

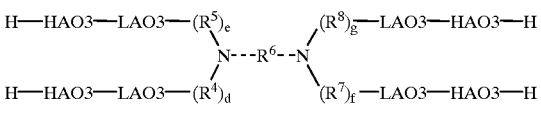

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that the LOL lipophilic block unit accounts for from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

$$(H\text{-}LAO4)_z\text{-}HOL\text{-}(LAO4\text{-}H)_{z^1} \quad (IX)$$

where

LAO4 in each occurrence represents a terminal lipophilic alkylene oxide block unit, HOL represents a hydrophilic alkylene oxide block linking unit, z is 2 and $z^1$ is 1 or 2.

The polyalkylene oxide block copolymer surfactants employed can take the form shown in formula X:

$$(H\text{-}LAO4\text{-}HAO4)_z\text{-}L^1\text{-}(HAO4\text{-}LAO4\text{-}H)_{z^1} \quad (X)$$

where

HAO4 in each occurrence represents a hydrophilic alkylene oxide block unit,

LAO4 in each occurrence represents a terminal lipophilic alkylene oxide block unit, $L^1$ represents a linking group, such as amine or diamine, z is 2 and $z^1$ is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

(XI)

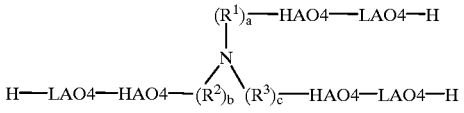

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When $z+z^1$ equal four, the linking group must be tetravalent. Diamines are preferred tetravalent linking groups. When a diamine is used to form the linking unit $L^1$, the polyalkylene oxide block copolymer surfactants employed can take the form shown in formula XII:

(XII)

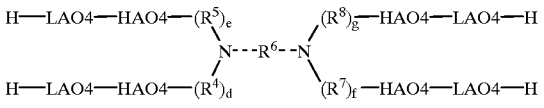

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO4 be chosen so that the HOL hydrophilic block unit accounts for from 4 to 96 percent, preferably 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H-HAO3-LAO3- or H-LAO4-HAO4- group satisfies formula XIIIa or XIIIb, respectively:

(XIIIa)

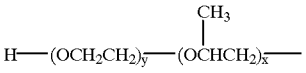

(XIIIb)

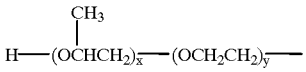

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV.

(XIV)

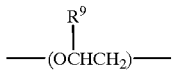

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

(XV)

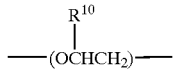

where $R^{10}$ is hydrogen or a hydrophilic group, such as a hydrocarbon group of the type forming $R^9$ above additionally having one or more polar substituents—e.g., one, two, three or more hydroxy and/or carboxy groups.

While it is possible to rely entirely on the surfactant to initiate grain clumping, other adjustments can be concurrently undertaken that, while incapable in themselves of creating grain clumping, significantly accelerate grain clumping in the presence of a surfactant. One preferred technique is to add iodide ion to the dispersing medium. The iodide ion can be added in the form of a water soluble salt, such as an alkali metal or ammonium iodide salt. Organic iodide releasing compounds can also be employed as a source of iodide ion, as illustrated by Takada et al U.S. Pat. No. 5,389,500 and Kikuchi et al EPO 0 561 415. Iodide concentrations useful for promoting clumping range from 0.1 to 10 mole percent, based on silver. For silver bromide grains preferred iodide levels are in the range of from 0.5 to 10 mole percent, based on silver. For silver chloride grains preferred iodide levels are in the range of from 0.1 to 1.0 mole percent, based on silver. These iodide levels refer to the iodide concentrations added in step (B) and exclude iodide, if any, incorporated in the grains in step (A). When both chloride and bromide ions are present within a grain, the preferred iodide ion addition level is the sum of the preferred iodide addition level based on chloride and the preferred iodide addition level based on bromide.

Another auxiliary clumping technique is to increase the pH of the dispersing medium to greater than 4. Shifting the pH of the dispersing medium to the range of from >4 is incapable of initiating grain clumping by itself, but in combination with the use of a surfactant, it increases the ease with which grain clumping is accomplished. It is, of course, recognized that pH values of >4 are common in silver halide grain precipitation. It is generally preferred to maintain pH during grain precipitation at a value of less than 8 to assure lower minimum density levels, and precipition on the acid side of neutrality (i.e., at a pH of less than 7 is specifically preferred. Thus, conventional techniques, typically the addition of a base, such as an alkali metal hydroxide or ammonium hydroxide, can be employed to adjust pH to a higher level. During step (A) the pH can take any convenient conventional value, but preferably is less than 4, with a pH of about 2 being a preferred maximum level of acidity. Achieving a desirably acid pH during step (A) can be accomplished by adding a mineral acid, such as nitric acid or hydrochloric acid.

After grain clumps of the desired ECD have been formed, it is necessary to stabilize the clumps against further aggregation. The addition of high methionine gelatin or gelatin derivative is a preferred technique for maintaining the grain clumps in a dispersed state while restraining further grain aggregation. The affinity for high methionine peptizer for the grain surfaces exceeds that of the surfactant adsorbed in step (B). Thus, in step (C) the high methionine peptizer displaces at least a portion of the surfactant from the grain surfaces. If any residual low methionine peptizer has remained adsorbed to the grain surfaces during step (B), it is also displaced by the high methionine peptizen It is contemplated to increase the concentration of the high methionine peptizer to greater than 10 g/L during step (C). In fact, it is conventional practice to increase markedly the proportion of gelatin contained in an emulsion after grain precipitation has been completed, the added gelatin acting as a binder in the coating composition. Thus, the high methionine gelatin or gelatin derivative is contemplated to be added to increase total peptizer and binder (i.e., vehicle) concentrations, up to those used during subsequent coating. However, prior to sensitization it is usually preferred to keep the total vehicle level in the dispersing medium at 50 g/L or less.

After grain clumps of the desired size have been formed, it is preferred to enhance the grain-to-grain contacts within each clump. The purpose of this is to facilitate conduction band electron transfer from grain to grain, so that the grain clump performance more nearly approximates that of a single grain of large surface area than the performance of the individual fine grains. It is contemplated to precipitate additional silver halide after the grain clumps are formed. The additional silver halide is grown onto the surfaces of the fine grains rather than forming new grains or new clumps of grains. Following conventional procedures for grain growth without renucleation insures that the further silver halide precipitation occurs on the existing grains. At and near the points of grain contact within a clump the conduction band electron transfer path between grains is enhanced by this further precipitation of silver halide. The additional silver halide precipitated in this step can account for up to 50 percent of the total silver precipitated. To enhance clump integrity and imaging performance, it is preferred to precipitate from 0.1 to 40 (optimally 10 to 30) percent of the total silver during this step.

Once steps (A) through (C) have been completed, a stable dispersion of silver halide grain clumps within a dispersing medium has been achieved. At this point the emulsion can be washed and sensitized immediately thereafter or stored for further preparation at a later time. Unlike Levy, the present invention does not require sensitization to be undertaken prior to or during grain aggregation to form clumps. By undertaking chemical and spectral sensitization after grain clump formation is complete, surface sensitizations are directed to the surfaces of the grains as clumped. Whereas, when sensitization precedes or occurs concurrently with clumping, a portion of the sensitization necessarily becomes occluded at the grain interfaces. When spectral sensitization is undertaken prior to grain clumping, it can be readily appreciated that the dye can actually act toward isolating the crystal lattice structure of one grain from that of another grain. Hence grain-to-grain electron transfer is not abetted, but actually made more difficult to achieve.

Gelatin and gelatin derivatives and alternative hydrophilic colloid peptizers contemplated for use in the practice of the invention are disclosed in *Research Disclosure*, Vol. 389, September 1996, Item 38957, II. Vehicles, vehicle extenders, vehicle-like addenda and vehicle related addenda. The vehicle teachings of Levy are here incorporated by reference.

Although the low methionine peptizer has been described with specific reference to gelatin and gelatin derivatives, it is appreciated that a large variety of hydrophilic colloids are known containing little or, in the overwhelming majority of instances, no methionine. These hydrophilic colloids are specifically contemplated as useful low methionine peptizers. It is specifically contemplated to employ as low methionine peptizers in step (A) starch and starch derivatives, including oxidized starch. While the utility of starch as a peptizer has been long appreciated, it has been recently discovered that cationic starch and cationic starch derivative (e.g., oxidized cationic starch) are highly useful in the preparation of tabular grain emulsions, as illustrated by Maskasky U.S. Pat. Nos. 5,604,085, 5,607,828, 5,620,840, 5,667,955, 5,691,131, 5,693,459, 5,726,008 and 5,733,718, herein incorporated by reference and hereinafter referred to as the Maskasky starch patents. While the Maskasky starch patents all embrace using cationic starch and oxidized cationic starch as a peptizer, at least the partial substitution of starch for gelatin or gelatin derivatives used as a binder for coating is also contemplated.

High methionine gelatin is specifically preferred for use as the high methionine peptizer used to displace surfactant and arrest further silver halide grain clumping in step (C). Any other conventional peptizer capable of displacing surfactant can be substituted for the high methionine gelatin. In general peptizers containing divalent sulfur atoms adsorb to silver halide grain surfaces similarly as high methionine gelatin and gelatin derivatives.

Although the invention has been described with specific reference to polyalkylene oxide block copolymer surfactants, it is appreciated that other surfactants, including particularly other polyalkylene oxide surfactants, capable of adsorbing to silver halide grain surfaces substituted in whole or part for the polyalkylene oxide block copolymers. Useful other surfactants can be selected from among the following conventional surfactants having known compatibility with silver halide emulsions:

Anionic Surfactants

Aerosol A-102™ Cytec Industries
- disodium ethoxylated alcohol half ester of sulfosuccinic acid Aerosol A-103™ Cytec Industries
- disodium ethoxylated nonylphenol half ester of sulfosuccinic acid Aerosol A-196™ Cytec Industries
- dialkylester of sodium sulfosuccinic acid Aerosol AY™ Cytec Industries
diamyl ester of sodium sulfosuccinic acid
Aerosol IB-45™ Cytec Industries
di-isobutyl ester of sodium sulfosuccinic acid
Aerosol MA-80-I™ Cytec Industries
dihexyl ester of sodium sulfosuccinic acid
Aerosol OS™ Cytec Industries
sodium isopropylnaphthalene sulfonate
Aerosol 18™ Cytec Industries
disodium N-octadecylsulfosuccinamate
Aerosol 22™ Cytec Industries
tetrasodium-N-(1,2-dicarboxyethyl)-N-octadecylsulfosuccinamate
Alkanol XC™ E.I. Dupont de Nemours and Co.
a mixture of di and tri(isopropyl)naphthalene sulfonate, sodium salt
Dowfax 2A1™ Dow Chemical Co.
sodium dodecyl diphenyl ether disulfonate
Dowfax 3B2™ Dow Chemical Co.
sodium n-decyl diphenylether disulfonate
Duponol C™ Witco Corp.
sodium lauryl sulfate
Duponol D™ Witco Corp.
mixture of sodium lauryl sulfonate and oleyl sulfates
Duponol EP™ Witco Corp.
diethanol amine lauryl sulfate
Duponol SN™ Witco Corp.
mixture of sodium decyl and lauryl sulfate
Duponol WA™ Witco Corp.
sodium lauryl sulfate
Duponol WN™ Witco Corp.
mixture of sodium octyl sulfate and sodium decylsulfate
Emcol K-8300™ Witco Corp.
disodium sulfosuccinate, half ester
Rhodapon TDS™ Rhone-Poulenc
sodium tridecylsulfate
Tergitol 7™ Union Carbide Co.
sodium sulfate of 3,9-diethyltridecanol-6
Triton X-200™ Union Carbide Co.
sodium octylphenol poly(ethylene oxide)sulfonate
Triton X-301™ Union Carbide Co.
sodium octylphenol poly(ethylene oxide)sulfate
Triton 770™ Union Carbide Co.
sodium octylphenol poly(ethylene oxide)sulfate Cationic Surfactants Adogen 464™ Witco Corp.
octyl and decyl trimethylammonium chloride
Atlas G-263™ ICI Americas Inc.
N-cetyl,N-ethyl morpholinium ethosulfate
Ethoquad C/25™ Akzo Nobel Chemicals Inc.
coco (omega-hydroxy,hepta-ethoxy)-(omega-hydroxy, octa-ethoxy)-methyl ammonium chloride Nonionic Surfactants Olin 10G ™ Olin Corp.
nonylphenoxydecaglycidol
Triton CF-10™ Union Carbide Co.
aryl-terminated polyethoxylated alkylphenol
Triton CF-54™ Union Carbide Co.
alkyl-terminated polyethoxylated alkylphenol
Triton DF-12™ Union Carbide Co.
modified polyethoxylated straight-chain alcohol
Triton DF-16™ Union Carbide Co.
alkyl-terminated polyethoxylated straight-chain alcohol
Triton DF-18™ Union Carbide Co.
modified polyethoxylated straight-chain alcohol
Triton N-101™ Union Carbide Co.
nonylphenoxy polyethoxy ethanol
Triton N-111™ Union Carbide Co.
nonylphenoxy polyethoxy ethanol
Triton X-100™ Union Carbide Co.
octylphenoxy$(CH_2CH_2O)_{9.5}H$
Triton X-102™ Union Carbide Co.
octylphenoxy$(CH_2CH_2O)_{12.5}H$
Triton X-165™ Union Carbide Co.
octylphenoxy$(CH_2CH_2O)_{16}H$ Apart from the features specifically described above, the preparation of emulsions containing dispersed clumps of radiation-sensitive silver halide grains can take any convenient conventional form. For example, the teachings of *Research Disclosure*, Item 38957, I. Emulsions, grains and their preparation are specifically contemplated. Grain doping can occur either during formation of the fine grains in step (A) or during the course of stabilizing the grain clumps by precipitating additional silver halide after step (C). The vehicles and vehicle like and/or vehicle related components (e.g. hardeners) disclosed in Item 38957, II. Vehicles, vehicle extenders, vehicle-like addenda and vehicle related addenda are specifically contemplated for use in the practice of the invention consistent with the peptizer descriptions provided above. Following formation of the emulsions by the process of the invention, they can be washed, as disclosed by Item 38957, III. Emulsion washing. The emulsions can be sensitized as disclosed by Item 38957, IV. Chemical sensitization and V. Spectral sensitization and desensitization and the sensitization teachings of Levy are here incorporated by reference. Conventional performance modifying addenda are contemplated for addition to the emulsions before coating, as illustrated by Item 38957, VI. UV dyes/optical brighteners/luminescent dyes, VII. Antifoggants and stabilizers, VIII. Absorbing and scattering materials, and X. Dye image formers and modifiers. The supports, remaining layers, exposure and processing of photographic elements in which the emulsions prepared by the process of the invention are prepared form no part of this invention and can take any convenient conventional form.

EXAMPLES

The invention can be further appreciated by reference to the following specific embodiments. The low methionine gelatin was treated with an oxidizing agent to reduce unoxidized methionine below measurable levels. References to bone gelatin indicate a gelatin naturally containing high levels of methionine and not treated with an oxidizing agent.

Example 1

Example Emulsion A

This example demonstrates the precipitation of a silver iodobromide (3 mole % iodide) emulsion containing dispersed clumps of fine grains.

An 18 liter reaction vessel was charged with an aqueous solution consisting of 6826 g of water, 158.9 g of alkali-processed low methionine gelatin, 2.52 g of sodium bromide, 2.10 g of antifoamant and 86.9 g of 4.0 M nitric acid. At 30° C. and with vigorous stirring, a 3.5 M silver nitrate solution and a 3.5 M sodium bromide solution were added simultaneously over 9 minute each at a flow rate of 325 mL/min. The sodium bromide addition rate was allowed to vary slightly to maintain pBr of 2.59.

To clump the fine grains precipitated in the previous paragraph, 143.9 g of 2.5 M sodium hydroxide solution were then added during a 1 minute hold to adjust the pH to about 6.0. After the pH adjustment, 13.0 g of a 70.8 wt % methanolic solution of Pluronic™ 31R1, a surfactant satisfying formula II, x=25, $x^1$=25, y=7, was added and allowed to disperse during a 2 minute hold. A mixed salt solution containing 0.5 M sodium bromide and 0.5 M potassium iodide was then added at 29.3 mL/min for 30 minutes.

To stabilize the grain clumps formed in the preceding paragraph, 3.5 M silver nitrate was then added at 111 mL/min for 11.3 minutes with 3.5 M sodium bromide added to control the pBr at 3.3.

Then, to avoid aggregation of grain clumps, 936.7 g of a 17% by weight bone gel solution was added and allowed to disperse for 10 minutes while the temperature was raised to 40° C.

The pBr was then adjusted to 2.44 with sodium bromide solution, and the emulsion was washed and concentrated by ultrafiltration. The high methionine bone gelatin in the amount of 267 g and a biocide were then added for storage.

The emulsion contained silver iodobromide grain clumps having a mean ECD of 0.6 μm. Scanning electron microscopy revealed the clumps to be comprised of silver iodobromide grains with a mean ECD of about 0.1 to 0.2 μm.

The silver halide exhibited a surface to volume ratio of 910 $m^2$ per Ag mole. This indicated success in forming grain clumps to achieve the light gathering capability of larger silver halide grains while retaining a much larger grain surface area than could be realized with larger grains.

Comparative Emulsion B

This emulsion was prepared to compare an emulsion having a silver iodobromide grain content similar to that of Emulsion A, but lacking the feature of grain clumps.

An 18 liter reaction vessel was charged with an aqueous solution consisting of 6826 g of water, 158.9 g of alkali-processed low methionine gelatin, 2.52 g of sodium bromide, 2.10 g of antifoamant and 86.9g of 4.0 M nitric acid. At 50° C. and with vigorous stirring, a 3.5 M silver nitrate solution and a 3.5 M sodium bromide solution were added simultaneously over 45 minute each at a flow rate of 15 mL/min. The sodium bromide addition rate was allowed to vary slightly to maintain pBr of 2.6.

Fine grains were formed in the preceding paragraph. The following steps were undertaken to parallel the preparation of Emulsion A, except that the polyalkylene oxide surfactant Pluronic™ 31R1 addition was omitted to avoid clumping the grains. To the above emulsion, 143.9 g of 2.5 M sodium hydroxide solution were then added during a 1 minute hold to adjust the pH to about 6.0. This was followed by the addition of 936.7 g of a 17% by weight high methionine bone gel during a 10 minute hold. A mixed salt solution containing 0.5 M sodium bromide and 0.5 M potassium iodide was then added at 29.3 mL/min for 30 minutes. The 3.5 M silver nitrate was then added at 111 mL/min for 11.3 minutes with the 3.5 M sodium bromide added to control the pBr at 3.3. The temperature was then reduced to 40° C. and the pBr was adjusted to 2.44 with sodium bromide solution. The emulsion was washed and concentrated by ultrafiltration. 267 g of bone gelatin and a biocide were then added for storage.

Observation of the emulsion revealed individual grains having a mean ECD of about 0.2 μm. Scanning electron microscopy revealed the grains to be individually dispersed rather than being clumped.

Sensitization and Photographic Evaluation

Emulsions A and B were chemically and spectrally sensitized as follows: To a quantity of emulsion melted at 40° C. were added 120 mg/ Ag mole of sodium thiocyanate followed by 1.44 mmole/ Ag mole of sensitizing dye A, anhydro-5-chloro-9-ethyl-5'-phenyl-3'-(3-sulfobutyl)-3-(3-sulfopropyl)-oxacarbocyanine hydroxide, sodium salt, followed by a 10 min hold and 0.32 mmole/Ag mole of sensitizing dye B, anhydro-3,9-diethyl-3'-methylsulfonylcar-bamoylmethyl -5-phenyloxathiocarbocyanine hydroxide, followed by a 10 min hold. After the hold, aurous dithiosulfate dihydrate and sodium thiosulfate pentahydrate were added along with 30 mg/mole of benzothiazolium triflouroborate salt. The emulsion was heated to 65° C. and held for up to 30 minutes before cooling to 40° C. and adding 1.0 g/ Ag mole of 4-hydroxy -6-methyl-1,3,3A,7-tetraazaindene (TAI).

The emulsions were coated in a single layer coating at 12.91 mg/$dm^2$ of silver with a cyan dye-forming coupler at 10.76 mg/$dm^2$ and total gel level at 26.9 mg/$dm^2$. TAI in the amount of 1.75 g per Ag mole was also added during coating. An overcoat of 32.28 mg/$dm^2$ of gel and surfactants was coated on top of the emulsion layer and the entire coating was hardened with bis(vinylsulfonylmethyl)ether.

The coatings were exposed through a step wedge for 0.04 sec with a Daylight V source filtered with a Wratten™ 9 filter (transmission at >460 nm). The exposed coatings were processed in the Kodak Flexicolor™ C41 color negative process. The cyan image dye density was read using a status M filtration.

Speed was measured at a toe density Ds, where Ds minus Dmin equal 20 percent of the slope of a line drawn between Ds and a point D' on the characteristic curve offset from Ds by 0.6 log E, where E represents exposure in lux-seconds. Speed is reported in relative log units, where a speed difference of 30 equals a difference of 0.3 log E.

TABLE I

| Emulsion | Surface Area/Ag Mole ($m^2$/Ag mole) | Relative Log Speed |
|---|---|---|
| A (example) | 910 | 250 |
| B (comparison) | 810 | 100 |

Table I shows that example Emulsion A and comparison Emulsion B, differing from Emulsion A in that the grains were not clumped, exhibited similar ratios of silver halide surface area to volume. The two emulsions also exhibited the same levels of absorption of green light (the spectral region of sensitization), indicating similar levels of spectral sensitizing, dye adsorbed to the grain surfaces.

The advantage of using clumped fine grains as opposed to individually dispersed fine grains is illustrated by the differences in the speeds of Emulsions A and B. Example Emulsion A exhibited a relative log speed 150 relative speed units higher than Comparison Emulsion B. That is, Emulsion A was about 32 times faster than Emulsion B.

Example 2

This example demonstrates the preparation of a silver iodobromide (4 mole % I, based on Ag) emulsion having larger mean ECD grains and larger mean ECD clumps.

Example Emulsion C

An 18 liter reaction vessel was charged with an aqueous solution consisting of 6828 g of water, 158.9 g of alkali-processed low methionine gelatin and 1.05 g of sodium bromide. At 30° C. and with vigorous stirring, a 3.5 M silver nitrate solution and a 3.45 M sodium bromide 0.05 M potassium iodide mixed salt solution were added simultaneously over 9 minute each at a flow rate of 325 mL/min. The mixed salt solution addition rate was allowed to vary slightly to maintain pBr of 2.89.

To clump the fine grains precipitated in the preceding paragraph, a 1.1 M potassium iodide solution was added at 400 mL/min over 1 minute followed by the addition of 60.4 g of a 70.8 wt % methanolic solution of Pluronic ™ 31R1 surfactant, followed by a 120 minute hold.

To stabilize the grain clumps formed in the preceding paragraph, a 3.5 M silver nitrate solution was added at 111 mL/min for 11.3 minutes with a 3.5 M sodium bromide solution added to control the pBr at 3.3. Then 454.2 g of a 35% by weight bone gel solution was then added and allowed to disperse for 10 minutes while the temperature was raised to 40° C.

The pBr was then adjusted to 2.41 with sodium bromide solution and the emulsion was washed and concentrated by ultrafiltration and a biocide was added for storage.

The emulsion contained silver iodobromide grains exhibiting a mean ECD of about 0.1 to 0.2 μm. The grains formed clumps having a mean ECD of 0.48 μm. A large fraction of the clumps exhibited an ECD between 1 and 2μm.

Example 3

This example demonstrates the practice of the invention in preparing high chloride emulsions.

Emulsion D

An 18 liter reaction vessel was charged with an aqueous solution consisting of 6912 g of water, 39.90 g of alkali-processed low methionine gelatin, 7.0 g) of sodium chloride, 2.10 g of antifoamant, and 71.74 g of 4.0 M nitric acid. At 30° C. and with vigorous stirring, a 3.5 M silver nitrate solution containing 25 mg/Ag mole of ethylthiosulfonate sodium salt and a 3.5 M sodium chloride solution were added simultaneously over 9 minute each at a flow rate of 325 mL/min. The sodium chloride addition rate was allowed to vary slightly to maintain pC1 at 1.88.

To clump the fine grains precipitated in the previous paragraph, 116.0 g of 2.5 M sodium hydroxide solution were then added during a 1 minute hold to adjust the pH to about 5.9. After the pH adjustment, 52.0 g of a 70.8 wt % methanolic solution of Pluronic™ 31R1 surfactant was added and allowed to disperse during a 2 minute hold.

To stabilize the grain clumps formed in the preceding paragraph, a mixed salt solution containing 0.167 M sodium chloride and 0.167 M potassium iodide was then added each at 29.3 mL/min for 30 minutes. A 3.5 M silver nitrate was then added at 111 mL/min for 11.3 minutes with a 3.5 M sodium chloride added to maintain a constant pC1. Then 936.7 g of a 17% by weight bone gel solution was added and allowed to disperse for 10 minutes while the temperature was raised to 40° C.

The emulsion was washed and concentrated by ultrafiltration followed by the addition of 386 g of bone gelatin and a biocide for storage.

The grain clumps exhibited a mean ECD of about 1 μm. Scanning electron microscopy revealed the clumps to contain grains with a mean ECD of about 0.2 to 0.3 μm. The ratio of silver halide surface area to volume, based on dye adsorption measurements, was about 700 $m^2$/Ag mole.

The invention has been described in detail with particular reference to certain preferred embodiments thereof, but it will be understood that variations and modifications can be effected within the spirit and scope of the invention.

What is claimed is:

1. A process of preparing a radiation-sensitive silver halide emulsion comprising (A) precipitating in an aqueous dispersing medium from 0.3 to 3 moles of silver per liter in the form of fine silver halide grains having a face centered cubic crystal lattice structure in the presence of at least 1 gram per liter of a peptizer, (B) aggregating the silver halide grains into dispersed clumps, the clumps having a mean equivalent circular diameter of less than 10 μm, and (C) stabilizing the clumps against further aggregation.

2. A process according to claim 1 wherein the fine grains have a mean equivalent circular diameter of less than 0.3 μm.

3. A process according to claim 1 wherein the peptizer employed in step (A) contains less than 30 micromoles of methionine per gram.

4. A process according to claim 3 wherein the peptizer contains less than 4 micromoles of methionine per gram.

5. A process according to claim 1 wherein a polyalkylene oxide surfactant is added in step (B).

6. A process according to claim 5 wherein the polyalkylene oxide surfactant is a non-ionic block copolymer.

7. A process according to claim 6 wherein the block copolymer contains at least two terminal hydrophobic groups.

8. A process according to claim 7 wherein the block copolymer satisfies the formula:

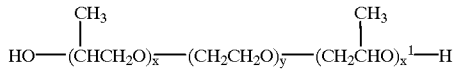

wherein x and $x^1$ are each 6 to 120 and y is 2 to 300.

9. A process according to claim 1 wherein iodide is added in step (B) to assist in aggregation of the silver halide grains.

10. A process according to claim 1 wherein the pH of the dispersing medium is adjusted to the range of from greater than 5 to less than 7 to assist in aggregation of the silver halide grains.

11. A process according to claim 1 wherein a high methionine peptizer is added in step (C) to stabilize the grains against further aggregation.

12. A process according to claim 1 wherein additional silver halide ranging up to 30 mole percent, based on silver, of total silver halide is precipitated in step (C) to stabilize the grains against further aggregation.

* * * * *